United States Patent [19]

Taniguchi

[11] Patent Number: 4,658,451

[45] Date of Patent: Apr. 21, 1987

[54] CARRIER FOR SUPPORTING USER'S BODY

[76] Inventor: Harushige Taniguchi, 4-432, Ikebukuro, Toshima-ku, Tokyo, Japan

[21] Appl. No.: 699,828

[22] Filed: Feb. 8, 1985

[30] Foreign Application Priority Data

Oct. 1, 1984 [JP] Japan ..... 59-203983
Oct. 12, 1984 [JP] Japan ..... 59-212498

[51] Int. Cl.[4] ..... A61G 7/10
[52] U.S. Cl. ..... 5/61; 5/81 R
[58] Field of Search ..... 5/60, 61, 66, 81 B, 5/83, 89, 425, 428, 429, 430, 445

[56] References Cited

U.S. PATENT DOCUMENTS

| | | | |
|---|---|---|---|
| 29,038 | 7/1860 | Keene | 5/60 |
| 554,580 | 2/1886 | Conkwright | 5/61 |
| 1,021,335 | 3/1912 | Robinson | 5/61 |
| 1,740,906 | 12/1929 | Rothauszky et al. | 5/66 |
| 2,113,286 | 4/1938 | White | 5/81 |
| 2,594,926 | 4/1952 | Hoffman | 5/430 |
| 2,680,855 | 6/1954 | Robinson | 5/83 |
| 2,698,445 | 1/1955 | More | 5/61 |
| 3,351,959 | 11/1967 | Turpin | 5/83 |
| 3,783,863 | 1/1974 | Kliever | 5/61 |
| 4,084,274 | 4/1978 | Willis et al. | 5/61 |
| 4,225,988 | 10/1980 | Cary et al. | 5/61 |
| 4,375,706 | 3/1983 | Finnhult | 5/61 |
| 4,486,908 | 1/1984 | Schroeder | 5/60 |

*Primary Examiner*—Gary L. Smith
*Assistant Examiner*—Michael F. Trettel
*Attorney, Agent, or Firm*—Charles E. Baxley

[57] ABSTRACT

A carrier is provided for changing the posture of a user. The carrier includes a first support frame for carrying thereon the user's body substantially in a horizontal rest posture at the normal position. The carrier also includes at least one second support frame swingably mounted to either side of the first support frame. The second support frame can support the user's body so that the user is lying on his side or can receive the user's body from the first support frame to make the user lie thereon in a topsy-turvy posture. The first and second support frames are swung in association so that the user is made to lie on his side or to lie in the topsy-turvy posture.

20 Claims, 17 Drawing Figures

CARRIER FOR SUPPORTING USER'S BODY

BACKGROUND OF THE INVENTION

1. Field of the Invention

The present invention relates to a carrier for supporting thereon a user's body, and more particularly to a bed or operation table capable of changing the posture of the user's body lying thereon.

2. Prior Art

A variety of beds, operating tables or other carriers for supporting patients thereon have been proposed. However, the known beds or operating tables have relatively complicated structures with restricted functions. A carrier of simple construction having a mechanism for changing the posture of the user's body has not yet been known.

OBJECTS AND SUMMARY OF THE INVENTION

A primary object of this invention is to provide a carrier for supporting thereon a user's body for changing the posture of the user's body into a desired condition where the user is lying on his side or in a supine or prone position.

A more specific object of this invention is to provide such a carrier operable to change the posture of the user, as desired, to prevent formation of bed sores and to promote metabolism of the patient without the need of lifting the patient's body into one's arms.

A further object of this invention is to provide such a carrier operable to change the posture of the user and/or to move the whole body of the user, as desired, to facilitate surgical operations, medical treatments, cleaning of the patient's body, exchange of clothes or sheets, and the bed making operation.

A still further object of this invention is to provide such a carrier provided with means for moving the user therefrom for bathing or other purposes.

The above and other objects of this invention will become apparent from the following detailed description.

The carrier for supporting a user's body and for changing the posture of the user, according to the present invention, comprises a first support means for carrying thereon the user's body substantially in a horizontal rest posture in the normal position; at least one second support means swingably mounted to either side of the first support means for supporting the user's body in such condition that the user is lying on his side and to receive the user's body from the first support means for supporting the user's body substantially in a horizontal rest posture in which the user is lying in a topsy-turvy posture; and drive means for pivoting the first and second support means to change the posture of the user.

DESCRIPTION OF PREFERRED EMBODIMENTS

The presently preferred embodiments of this invention will now be described with reference to the appended drawings.

Figure 1:
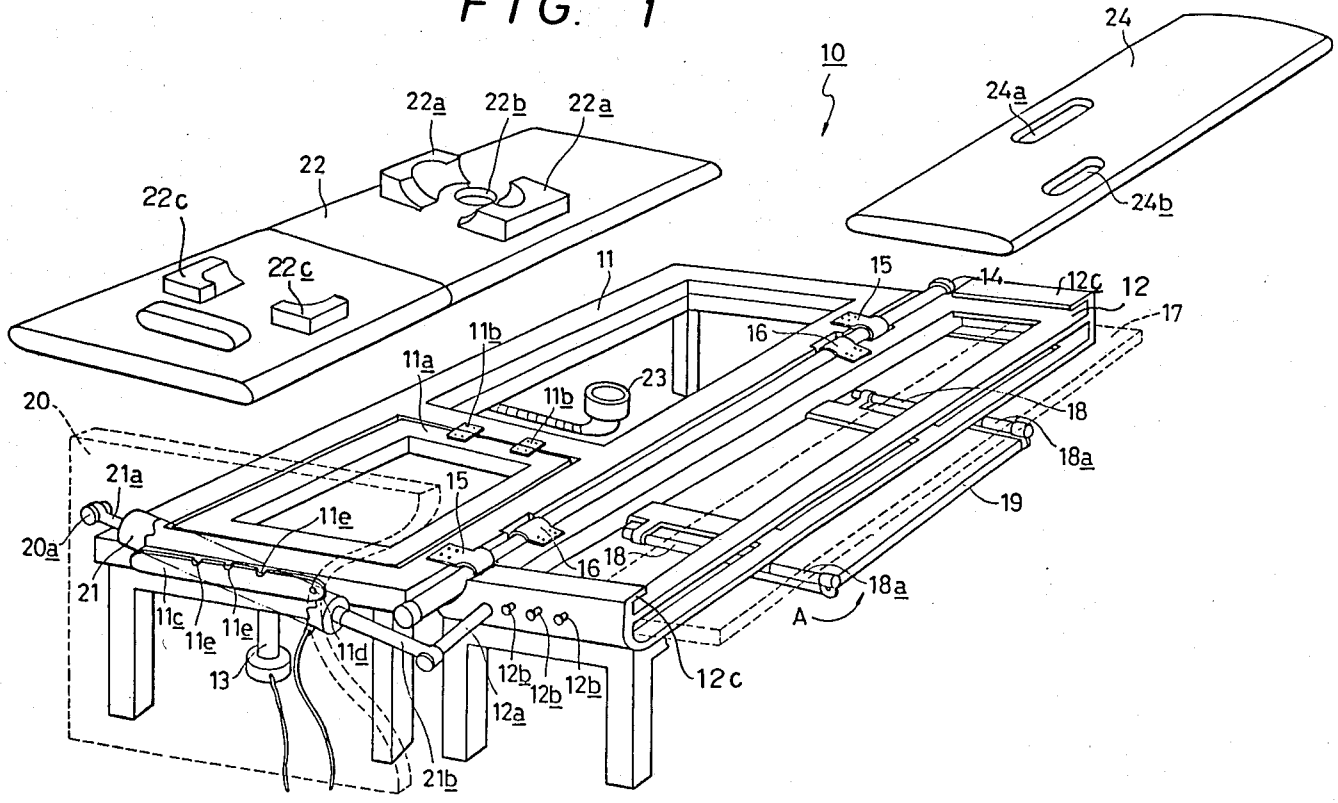
FIG. 1 is a partial perspective view of a bed embodying the present invention, wherein certain parts are shown disassembled for simplification of illustration.
Figure 2:
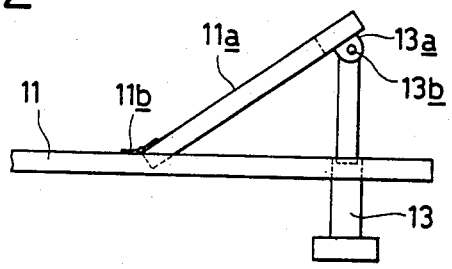
FIG. 2 is a fragmentary view showing the side elevation of the reclining means incorporated in the bed of FIG. 1.

FIGS. 1 to 6 show a bed embodying the carrier for supporting a patient according to this invention. Initially referring to FIG. 1, a bed embodying the invention is generally denoted by numeral 10. The bed 10 has a main frame 11 for supporting thereon a patient in the supine posture at the normal position, and a side frame 12 for supporting the patient in the prone posture as will be described in detail hereinafter. As seen from FIGS. 1 and 2, the main frame 11 includes a reclining frame **11*a* mounted by means of hinges 11*b*. The underside of the reclining frame 11*a* is engaged by an engagement member 13*a* of a screw-type jack 13 so that the reclining frame 11*a* may be inclined and fixed at a desired position when the patient desires to sit on the bed 10. As best seen in FIG. 2, the engagement member 13*a* is swingable about an axis 13*b* to change the angular position depending on the inclination of the reclining frame 11*a*. Although one reclining frame for reclining the back of the user is assembled in the main frame 11 in the illustrated embodiment, a reclining frame for raising the legs of the user may be assembled in the main frame in place of or in addition to the illustrated reclining frame 11*a*. When the main frame 11 is pivoted to change the posture of the patient as will be described hereinafter, the reclining frame 11*a* is returned back to the position shown in FIG. 1**.

The main frame 11 is pivotally mounted at its one side to a pivot shaft 14 by means of hinges 15, and the side frame 12 is also pivotally mounted at its one side to the same pivot shaft 14 by means of hinges 16. A slide plate 17 is contained in the side frame 12 and capable of extension to widen the side frame 12, as desired, to increase the area of the side frame. A grasping bar 18 extends in the side frame 12 in the transverse direction so that the patient can grasp the bar 18 to hold his body by himself during posture changing operations. The grasping bar 18 is paired with another bar 18 extending similarly in the side frame 12 in the transverse direction, and these bars 18 have the free ends sheathed with cylinders **18*a* which are extensible transversely and a protection plate 19 is mounted between the paired bars 18. The protection plate 19 may be swung in the direction shown by the arrow A to ensure protective function (see FIG. 5**).

A fixed plate or wall 20 stands vertically from the floor and positioned close to the end face of one side of the main frame 11. A pin **20*a* is mounted at a pertinent position of the fixed wall 20 and pivotally connected to the bottom extension 21*a* of the piston rod of a piston-cylinder unit 21 actuated by fluid pressure. The other end, i.e. the foreward extension 21*b* of the piston rod of the piston-cylinder unit 21 is pivotally connected to a fixed pin 12*a* fixed to the end plate of the side frame 12**.

The piston rod extensions 21*a* and/or 21*b* are extended and retracted by a not-shown actuator.

A fastener member 11*c* provided with a plurality of indents 11*e* for snugly engaging with set pins 12*b* protruding from the end plate of the side frame 12 is swingably attached to the end face of the main frame 11 so that the fastener member 11*c* is swung about an attachment pin 11*d*.

A main support mat 22 is securely placed on the main frame 11 and has waist pads 22*a* for holding the waist of the patient in situ. An opening 22*b* is formed through the mat 22 at the region surrounded by the pads 22*a*, and a discharge pipe 23 having an inlet port positioned beneath the opening 22*b* is disposed to deliver liquid and solid wastes to the outside. The main support mat 22 is further provided with shoulder pads 22*c* for securely holding the shoulders of the patient. A side support mat 24 is placed on the side frame 12. As shown in FIG. 1, flanges 12*c* extend inward from the end edges of the transverse end faces of the side frame 12 so that the side support mat 24 is slidingly contained below the flanges 12*c* to be in the extended position as necessity arises. The side support mat 24 is also provided with a slot 24*a* through which the patient reaches out his hand to seize the the grasping bar 18 during the posture change operation. An opening or concavity 24*b* is provided at a pertinent area of the mat 24 to prevent compressive force from being applied to the heart of the patient during and after the posture change operation.

Figure 3:
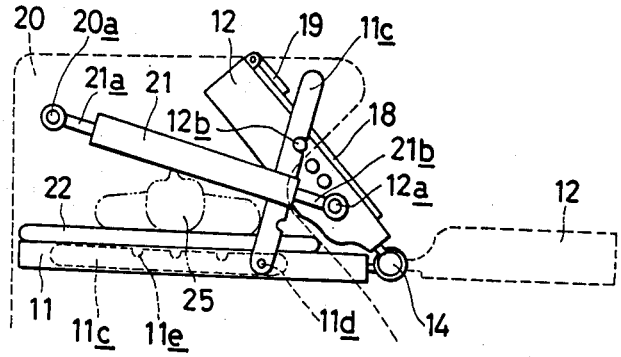
FIGS. 3 to 6 are schematic illustrations showing the position change operations of the bed of FIG. 1.
Figure 4:
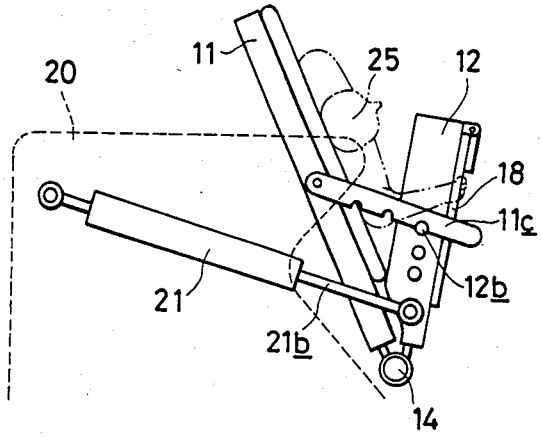
Figure 5:
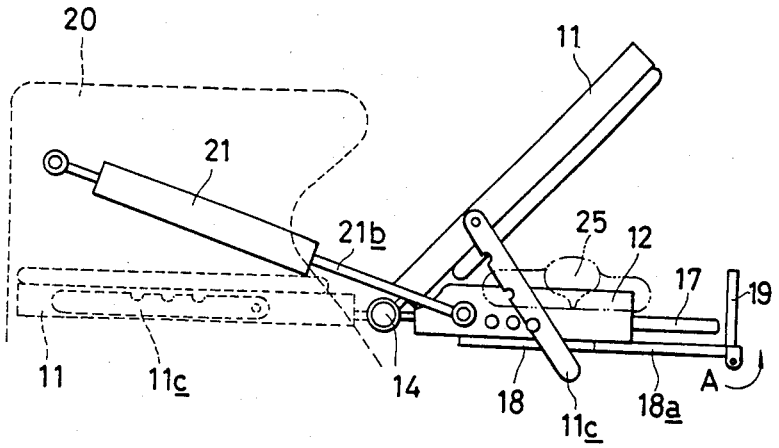

Referring to FIGS. 3 to 5, the operation of changing the posture of the patient from the supine position to the prone position will now be described. At the initial step, the piston rod 21*b* is retracted by actuating the piston-cylinder unit 21, whereupon the side frame 12 is swung about the pivot shaft 14 from the position shown by the broken line to the position shown by the real line in FIG. 3 so that the side frame 12 overhangs the patient's body 25. At that position, the fastener member 11*c* is swung about an attachment pin 11*d* from the position shown by the broken line to the position shown by the real line so that one of the set pins 12*b* is engaged in one of the indents 11*e*. Although the side mat 24 is not extended in the illustrated operation example, the side mat 24 may be extended to prevent the patient's body from jutting out of the mat 24.

Thereafter, the piston rod 21*b* of the piston-cylinder unit 21 is extended, whereby the main frame and the side frame are tilted to move to the position as shown in FIG. 4 since the frames 11 and 12 are united together by means of the fastener member 11*c* so that the patient 25 is laid on his side. During this step of posture change operations, the patient 25 can reach his hand through the opening 24*a* of the side mat 24 to seize the grasping bar 18 for holding the position of his body.

Upon turning the patient into the prone position, the piston rod 21*b* is further extended, as shown in FIG. 5, to swing the side frame 12 to the horizontal position. The slide plate 17 and the cylinders 18*a* may be extended and the protection plate 19 may be swung in the direction as shown by the arrow A to an upstanding protective position, if necessary. If it is desired to hold the patient in this posture, the fastener member 11*c* is released from the side frame 12 by a nurse or helper and the main frame 11 is returned back to the position shown by the broken line in FIG. 5 manually or by chain or other driving means (not shown).

Figure 6:
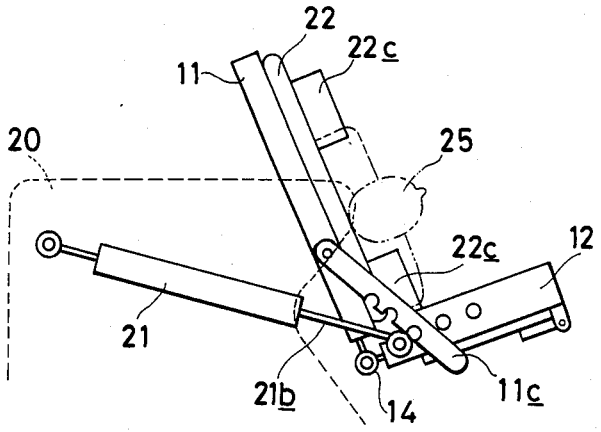

If it is desired to hold the patient in the position of lying on the side, the side frame 12 is set and fixed by the fastener member 11*c* at the position relative to the main frame 11 where the side frame extends perpendicular to the main frame at the initial step of the posture change operations, and then the piston-cylinder unit 21 is actuated to swing the joined main and side frames to the desired position as shown in FIG. 6. At this position, the major portion of the weight of the patient is carried by the side frame 12 while the shoulders and waist of the patient are held by the waist pads 22*a* -and the shoulder pads 22*c* so that the patient is held in the posture lying on his side.

Figure 7:
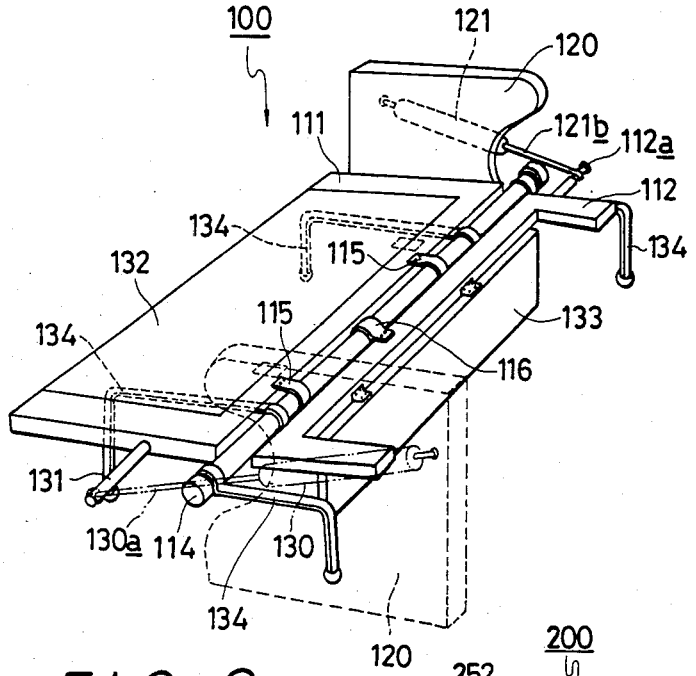
FIG. 7 is a partial perspective view of an operating table embodying the present invention.

FIG. 7 shows an operating table 100 embodying the carrier of the present invention. In FIG. 7, the same parts as those of the bed 10 shown in FIGS. 1 to 6 are denoted by reference numerals having the same number as used in FIGS. 1 to 6, with one hundred added thereto, and the duplicative descriptions thereof will be omitted. In the operating table shown in FIG. 7, two piston-cylinder units 121 and 130 each actuated by fluid pressure are used, contrary to the aforementioned bed 10. The piston rod 130*a* of the piston-cylinder unit 130 is pivotally connected to a pin 131 fixed to a main frame 111 which is pivotable about a pivot shaft 114. In position change operation, the piston-cylinder units 121 and 130 are actuated co-operatively to move the main frame 111 and the side frame 112 in a manner similar to that described with reference to FIGS. 3 to 6. A main frame plate 132 is attached to the main frame 111 such that the plate 132 may be folded downwards to allow closer access to the patient if necessity arises during the operation. A side frame plate 133 is attached to the side frame 112 similarly to allow the downward folding thereof for the same purpose. Two sets of plate support legs 134, one set for each of the plates 132 and 133, are slidingly mounted on the pivot shaft 114. As shown in FIG. 7, one set of support legs 134 for supporting thereon the side frame plate 133 is moved to both ends of the shaft 114 so that the support legs 134 do not obstruct such closer access when the side frame plate 133 is folded downward.

Meanwhile, the bed 10 shown in FIGS. 1 to 6 may be provided with two piston-cylinder units which are actuated by fluid pressure to operate the bed 10, similarly to the operating table 100 shown in FIG. 7.

Another embodiment of the carrier, according to the invention, is shown is FIGS. 8 to 12 and generally denoted by reference numeral 200. In FIGS. 8 to 12, the same parts as those of the bed 10 shown in FIGS. 1 to 6 are denoted by the reference numerals having the same number as used in FIGS. 1 to 6, with two hundred added thereto, and the duplicative descriptions thereof will be omitted. In the bed 200, a first side frame 212 is mounted at one side of a main frame 211 by means of hinges 251, and a second side frame 250 is mounted at the other side of the main frame 211 by means of hinges 252. The main frame 211 is mounted to two fixed plates or walls 220 upstanding vertically from the floor respectively through pivot shafts 253 and 254 so as to be pivotable thereabout. A gear 255 is mounted on the pivot shaft 253 and meshed with a chain 256 which is driven by a motor 257 provided with a reduction gear. Upon energization of the motor 257, the main frame 211 is pivoted in the clockwise or counter-clockwise direction about the pivot shafts 253 and 254.

A plate 258 is fixed to the main frame 211, and pivot pins 258*a* and 258*b* protrude from the plate 258. One end of a piston rod 221*a* of the piston-cylinder unit 221 is connected to the pin 258*a*, and the end of the other piston rod 221*b* of the piston-cylinder unit 221 is connected to a pivot pin 212*a* secured to the side frame 212. Similarly, one end of a piston rod 259*a* of the piston-cylinder unit 259 is connected to the pin 258*b*, and the end of the other piston rod 259*b* of the piston-cylinder unit 259 is connected to a pivot pin 250*a* secured to the side frame 250.

Figure 8:
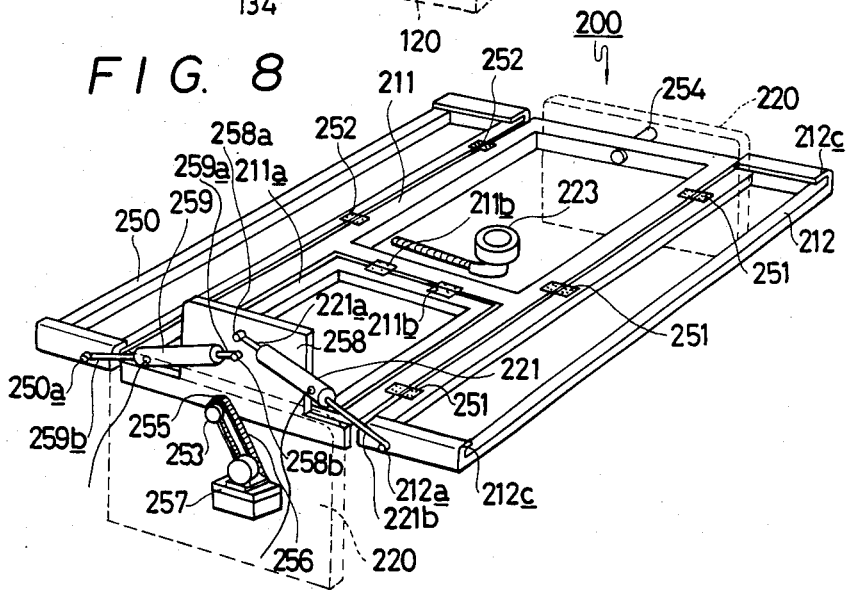
FIG. 8 is a partial perspective view of another type of bed embodying the present invention, wherein certain parts are shown disassembled for simplification of illustration.

Although the slide plates 17, grasping bars 18, extensible sheath cylinders 18*a* and protection plates 19 are not shown in FIG. 8, the same or similar parts may be assembled in the side frames 212 and 250. Likewise, the main frame mat 22 and the side frame mat 24 may be used similarly as in the embodiment shown in FIG. 1.

Figure 9:
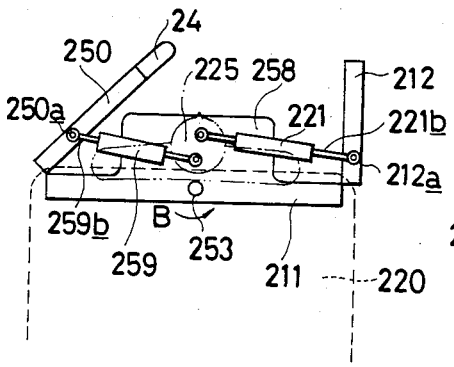
FIGS. 9 to 12 are schematic illustrations showing the position change operations of the bed of FIG. 8.
Figure 10:
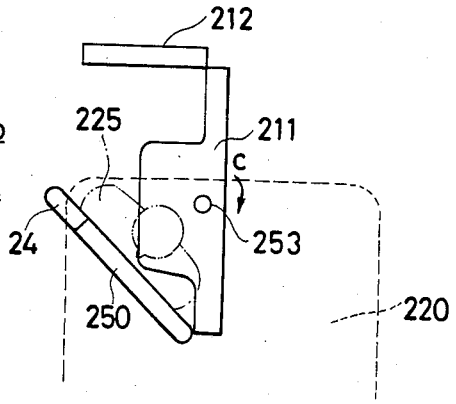

The operation for changing the posture of a patient 225 from the supine position to the prone position will now be described with reference to FIGS. 9 to 11. In the initial condition shown in FIG. 9, the patient is in the supine posture. The side frame mat 24 of the side frame 250, onto which the patient is transferred, is extended and then the piston-cylinder unit 259 is actuated by fluid pressure to retract the piston rod 259*b*, whereby the side frame 250 is swung to overhang the patient's body 225. The other side frame 212 is also swung by retracting the piston rod 221*b* by the actuation of the piston-cylinder unit 221 to move to a position at which the side frame 212 upstands substantially perpendicular relative to the main frame 211 so that the side frame 212 does not hinder the pivotal movement of the entire structure. Thereafter, the motor 257 provided with the reduction gear is energized to swing the main frame 211 about the pivot shaft 253 in the counter-clockwise direction, i.e. the direction shown by the arrow B in FIG. 9, whereby the patient's body 225 is transferred onto the side frame 250 as shown in FIG. 10. Subsequently, while extending the piston rod 259*b*, the main frame 211 is swung about the pivot shaft 253 in the clockwise direction, i.e. the direction shown by the arrow C in FIG. 10, to the horizontal position as shown in FIG. 11 at which the patient 225 is lying in the prone posture on the side frame 250.

Figure 11:
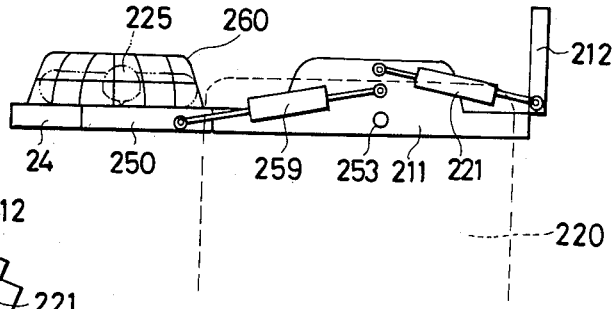
Figure 12:
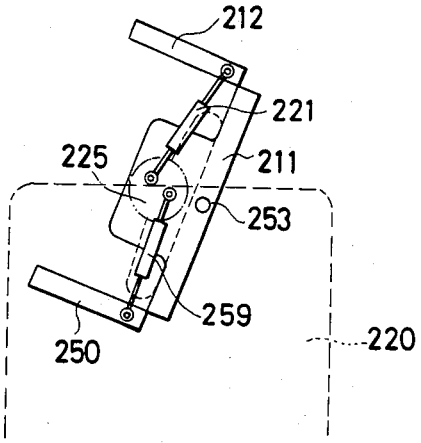

In the position shown in FIG. 12, the patient 225 is held in the posture of lying on his side. In this case, the side frames 250 and 212 are swung such that they extend substantially perpendicular to the plane of the main frame 211 so as to allow the weight of the patient 225 to be carried by one of the side frames 250 or 212 without excessive compressive force. Distinctive from the embodiment shown in FIGS. 1 to 6, since the embodiment shown in FIGS. 8 to 12 is provided with two side frames 212 and 250 at both sides of the main frame 211, the motor 257 provided with a reduction gear (see FIG. 8) is actuated to pivot the main frame 211 about the pivot shaft 253 in either of the clockwise or counter-clockwise direction. The patient can, thus, change the posture arbitrarily from one side to the other side if the patient is fatigued in one posture.

The bed 10 shown in FIGS. 1 to 6 and the bed 200 shown in FIGS. 8 to 12 may be used for allowing the patient to take a bath. The bathing operation will be described, for example, with the use of the bed 200 illustrated in FIGS. 8 to 12.

Figure 13:
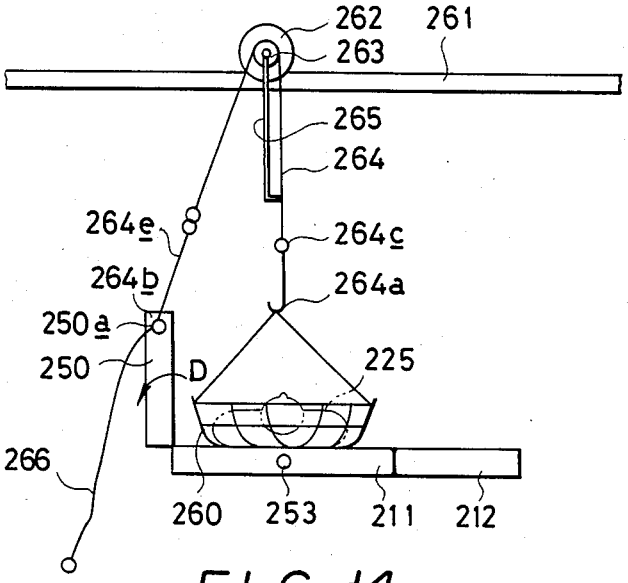
FIGS. 13 to 17 are schematic illustrations showing the operations of transporting the patient for bathing while using the mechanism incorporated in the bed of FIG. 8.
Figure 14:
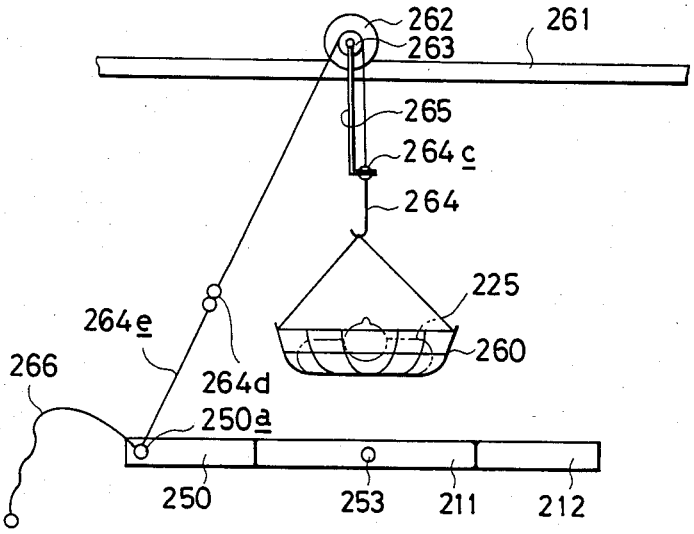

A bathing cage 260 is put on the patient 225 lying in the prone posture as shown in FIG. 11, and then the bed 200 is operated in the sequence reverse to the operation sequence as described with reference to FIGS. 9 and 10 for changing the posture into the prone position, whereby the patient 225 is laid in the bathing cage while lying in the supine position as shown in FIG. 13. One end 264*a* of a rope 264 suspended from a pulley 263 integrally mounted to a wheel 262, which runs along an overhead rail or track 261, is then connected to the cage 260 by a hook or other means. The other end 264*b* of the rope 264 is fixed to a fastener 250*a* fixedly secured to the side frame 250. Upon swinging the side frame 250 in the direction shown by the arrow D, the cage 260 is raised as shown in FIG. 14. The cage 260 is held in this raised position by fixing the hook 265 to a ring 264*c* secured intermediately of the rope 264.

Figure 15:
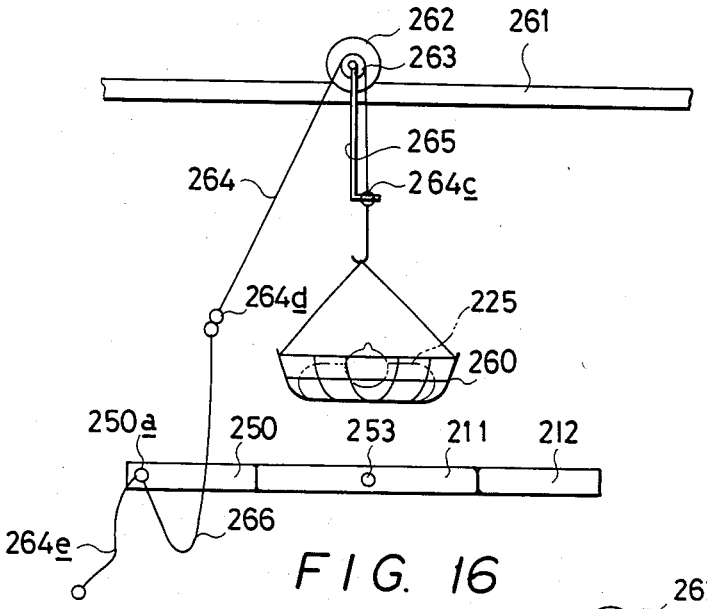
Figure 16:
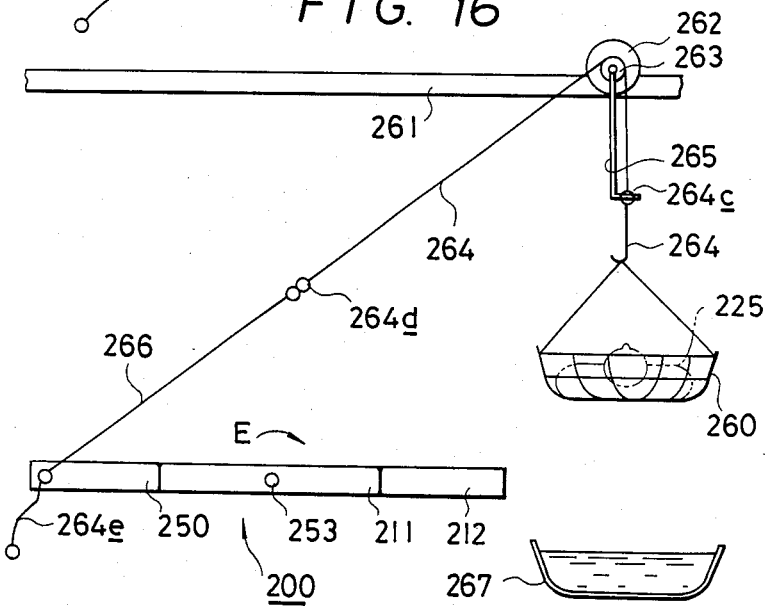
Figure 17:
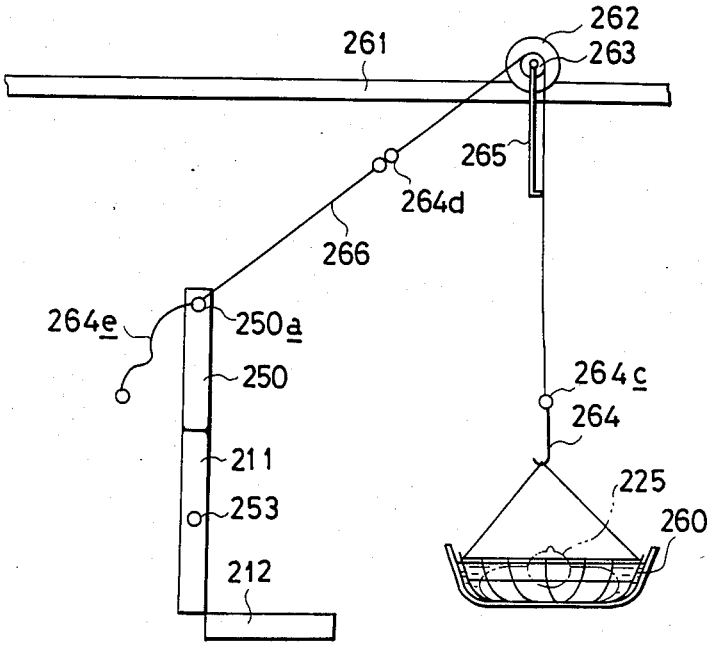

Then a short rope 264*e* is removed from a hook 264*d* disposed intermediately of the rope 264 and one end of a long rope 266 is engaged by the hook 264*d* with the other end of the rope 266 being fixed to the fastener 250*a*, as shown in FIG. 15. The wheel 262 is then allowed to run along the rail 261 manually or any other means to move the cage 260 above a bath 267 placed at the side of the bed 200, as shown in FIG. 16. Then, the ring 264*c* is released from the hook 265 and the main frame 211 is swung in the direction shown by the arrow E in FIG. 16 about the pivot shaft 253 to lower the cage 260 into the bath 267 as shown in FIG. 17. After the completion of bathing, the patient is returned to the bed 200 following to the operation sequence reverse to that described above.

Incidentally, the cage 260 is moved by the rotational movement of the main frame 211 and the side frame 250 in the illustrated embodiment. One skilled in the art may modify the cage 260 associated with the movement of the reclining means 13, 13*a* and 11*a*.

Although the present invention has been described by referring to preferred embodiments thereof, it is not intended to limit the same only to the illustrated embodiments but to embrace all changes and modifications thereof which can be conceived without departing from the spirit of the invention. The scope of the present invention should be defined only by the appended claims.

What is claimed is:

1. A carrier for supporting a user's body and for changing a horizontal rest posture of the user to a topsy-turvy posture, comprising:

a first support means for normally carrying thereon the user's body substantially in the horizontal rest posture, said first support means being movable to a vertical upright position so that the posture of the user is changed to the topsy-turvy posture, at least one second support means pivotally mounted to one side of said first support means, said second support means being pivotable to overlie and sandwich the user's body when changing the posture of the user and being rotatable together with said first support means to transfer the user's body from said first support means to said second support means, and drive means operatively associated with at least one of said first and second support means for rotating said first and second support means together to transfer the user's body from said first support means to said second support means.

2. The carrier according to claim 1, wherein said drive means is operatively associated with only one of said first and second support means and wherein said first and second support means are linked together by link means.

3. The carrier according to claim 1, wherein a said second support means is provided at each side of said first support means.

4. The carrier according to claim 3, further comprising second drive means for pivoting said first support means about a pivot axis extending substantially along the longitudial center line of said first support means.

5. The carrier according to claim 3, wherein each said second support means is operatively associated with a corresponding drive means.

6. The carrier according to claim 1, wherein said first support means is provided with fixation means for fixing the user's body in situ on said first support means.

7. The carrier according to claim 1, wherein said first support means is provided with an opening through which liquid and solid body wastes are discharged.

8. The carrier according to claim 1, wherein said second support means is provided with removal prevention means for preventing the user's body from being removed from said second support means when said user's body is transferred from said first support means to said second support means while changing the the user's body into the topsy-turvy posture.

9. The carrier according to claim 8, wherein said removal prevention means is a ledge member slidingly contained in said second support member and adapted to be extended sideward of said second support means.

10. The carrier according to claim 8, wherein said removal prevention means is a grasping bar to be grasped by the user's hand.

11. The carrier according to claim 1, wherein said second support means is provided with removal prevention means for preventing the user's body from being removed from said second support means when said user's body is laid on said second support means substantially in a horizontal rest posture, said removal prevention means being a member which is contained in said second support means and which is extensible and pivotable to an upstanding protective position.

12. The carrier according to claim 1, wherein at least one of said first and second support means is provided with a recess or opening for preventing compressive force from being applied to the heart of the user.

13. The carrier according to claim 1, wherein at least one of said first and second support means is provided with reclining means.

14. The carrier according to claim 1, wherein said drive means includes a piston-cylinder unit actuated by fluid pressure, and a link mechanism for linking said piston-cylinder unit with at least one of said first and second support means.

15. The carrier according to claim 1, further comprising:

movable carriage means for supporting thereon the user's body when it is desired to raise said user's body from said first support means;

elevator means for suspending said movable carriage means to raise or lower the same; and transport means for moving said elevator means therealong;

said elevator means being operatively associated with drive means for operating said reclining means to raise or lower said movable carriage means.

16. A carrier for supporting a user's body and for changing a horizontal rest posture of the user to a topsy-turvy posture, comprising:

a first support means for normally carrying thereon the user's body substantially in the horizontal rest posture, said first support means being movable to a vertical upright position so that the posture of the user is changed to the topsy-turvy posture, at least one second support means pivotally mounted to one side of said first support means, said second support means being pivotable to overlie and sandwich the user's body when changing the posture of the user and being rotatable together with said first support means to transfer the user's body from said first support means to said second support means, drive means operatively associated with at least one of said first and second support means for rotating said first and second support means together to transfer the user's body from said first support means to said second support means, movable carriage means for supporting thereon the user's body when it is desired to raise the user's body from said first support means, elevator means for suspending said movable carriage means to raise or lower the same, and transport means for moving said elevator means therealong, said elevator means being operatively associated with said drive means to raise or lower said movable carriage means.

17. The carrier according to claim 16, wherein said elevator means includes a pulley and a wire or rope having one end connected to said movable carriage means and the other end connected to said first support means.

18. The carrier according to claim 16, wherein said elevator means includes a pulley and a wire or rope having one end connected to said movable carriage means and the other end connected to said second support means.

19. The carrier according to claim 16, wherein said transport means includes an overhead track and wheel or roller means connected to said pulley and adapted to run along said overhead truck.

20. The carrier according to claim 16, further comprising holder means for holding said movable carriage means at a fixed height while said movable carriage means is moved or transported along said transport means.

* * * * *